US009207694B2

(12) United States Patent
Yahagi et al.

(10) Patent No.: US 9,207,694 B2
(45) Date of Patent: Dec. 8, 2015

(54) METHOD OF MEASURING CHARACTERISTICS OF A PROTECTION CIRCUIT FOR A LINEAR VOLTAGE REGULATOR

(71) Applicant: Seiko Instruments Inc., Chiba-shi, Chiba (JP)

(72) Inventors: Akihito Yahagi, Chiba (JP); Takashi Imura, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 83 days.

(21) Appl. No.: 14/273,156

(22) Filed: May 8, 2014

(65) Prior Publication Data

US 2014/0347022 A1 Nov. 27, 2014

(30) Foreign Application Priority Data

May 23, 2013 (JP) ..... 2013-109265
Feb. 3, 2014 (JP) ..... 2014-018757

(51) Int. Cl.

| | |
|---|---|
| ***G05F 1/573*** | (2006.01) |
| ***G05F 1/56*** | (2006.01) |
| ***G05F 1/565*** | (2006.01) |
| *G05F 1/575* | (2006.01) |

(52) U.S. Cl.
CPC *G05F 1/56* (2013.01); *G05F 1/565* (2013.01); *G05F 1/573* (2013.01); *G05F 1/575* (2013.01)

(58) Field of Classification Search
CPC ..... G05F 1/573; G05F 1/569; G05F 1/571; G05F 1/5735; G05F 1/575; G05F 1/577; G05F 1/567; G05F 1/461; G05F 1/462; G05F 1/463; H02M 1/32; H02M 2001/322; H02M 2001/325; H02M 2001/327; H02M 1/36
See application file for complete search history.

(56) References Cited

U.S. PATENT DOCUMENTS

| | | | | |
|---|---|---|---|---|
| 3,872,386 A * | 3/1975 | Luhowy | G01R 17/22 | 324/133 |
| 2005/0185490 A1* | 8/2005 | Zhang | G11C 5/147 | 365/205 |
| 2012/0112718 A1* | 5/2012 | Pons | G05F 1/575 | 323/281 |

FOREIGN PATENT DOCUMENTS

JP 04-195613 A 7/1992

* cited by examiner

*Primary Examiner* — Harry Behm
*Assistant Examiner* — Peter Novak
(74) *Attorney, Agent, or Firm* — Brinks Gilson & Lione

(57) ABSTRACT

Provided is a voltage regulator capable of accurately adjusting a tail current of a differential amplifier circuit without adding a test terminal. The voltage regulator includes: a constant current circuit for causing the tail current of the differential amplifier circuit to flow; a protection circuit; a current output circuit for outputting a current of the constant current circuit to a test terminal for measuring characteristics of the protection circuit; a switch circuit for stopping a function of the protection circuit; and a fuse provided between the test terminal and the current output circuit.

4 Claims, 4 Drawing Sheets

METHOD OF MEASURING CHARACTERISTICS OF A PROTECTION CIRCUIT FOR A LINEAR VOLTAGE REGULATOR

RELATED APPLICATIONS

This application claims priority under 35 U.S.C. §119 to Japanese Patent Application Nos. 2013-109265 filed on May 23, 2013 and 2014-018757 filed on Feb. 3, 2014, the entire contents of which are hereby incorporated by reference.

BACKGROUND OF THE INVENTION

1. Field of the Invention

The present invention relates to a voltage regulator, and more specifically, to a test circuit of a voltage regulator.

2. Description of the Related Art

FIG. 2 illustrates a block diagram of a related-art voltage regulator.

The related-art voltage regulator includes a reference voltage circuit 2, a voltage divider circuit 3, an output transistor 4, a differential amplifier circuit 10, and a constant current circuit 11, and is configured to output a predetermined output voltage Vout based on an input voltage Vin.

The voltage regulator includes a protection circuit 13 used for overcurrent protection or overheat protection. The protection circuit 13 is an important circuit for protecting the circuit of the voltage regulator, and is therefore required to be high in accuracy. Thus, in a manufacturing process, characteristics of the protection circuit 13 are measured to adjust the accuracy. The voltage regulator includes a test circuit or a test terminal used for this adjustment.

Further, the voltage regulator is required to be low in current consumption, and hence, for example, it is necessary to accurately adjust a tail current 110 of the differential amplifier circuit 10. In general, the tail current 110 is adjusted through trimming of a transistor included in the constant current circuit 11 (see, for example, Japanese Patent Application Laid-open No. Hei 04-195613).

However, the tail current 110 is a constant current to be used only inside an integrated circuit, and hence there is a problem in that a terminal for measurement is necessary for accurately adjusting the tail current 110 and the area increases accordingly.

SUMMARY OF THE INVENTION

Thus, a voltage regulator according to one embodiment of the present invention is configured so that a terminal for measuring a tail current of a differential amplifier circuit is used in common with a test terminal of a protection circuit, thereby being capable of accurately measuring the tail current without increasing the number of test terminals.

According to the voltage regulator of one embodiment of the present invention, the terminal for measuring the tail current and the test terminal of the protection circuit are used in common, and hence the tail current can be accurately measured without increasing the number of test terminals.

DETAILED DESCRIPTION OF THE PREFERRED EMBODIMENTS

Now, a voltage regulator according to the present invention is described below with reference to the accompanying drawings.

First Embodiment

Figure 1:
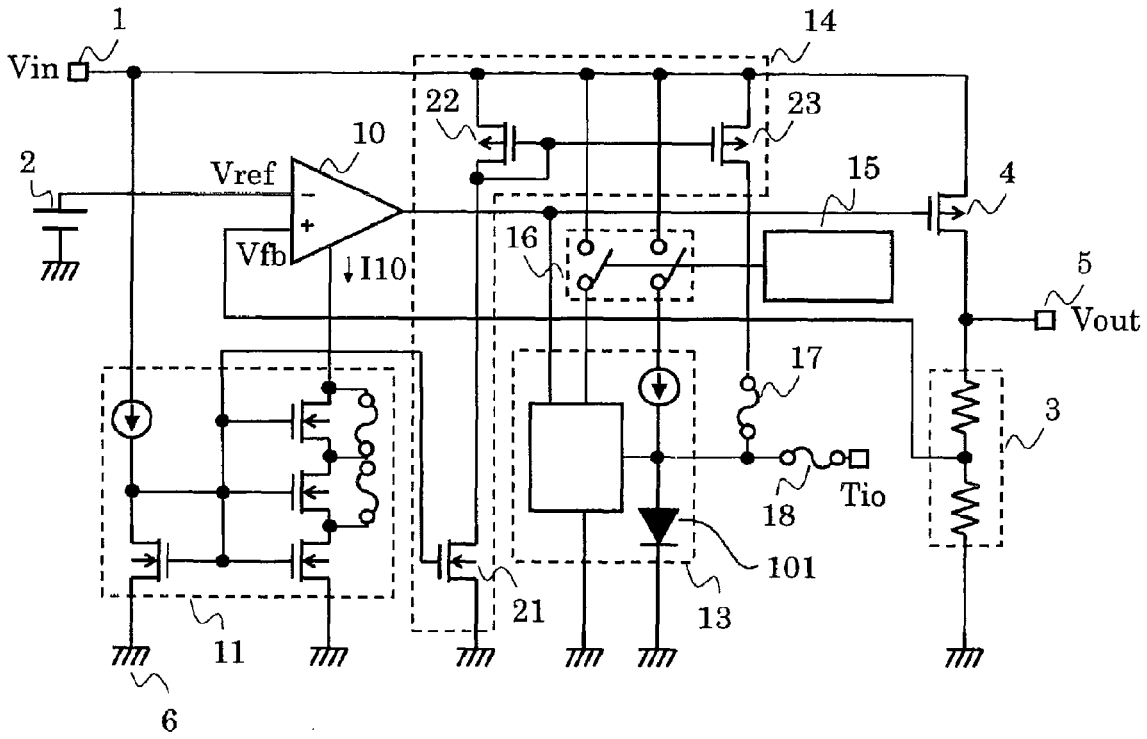
FIG. 1 is a circuit diagram illustrating a voltage regulator according to a first embodiment of the present invention.
Figure 2:
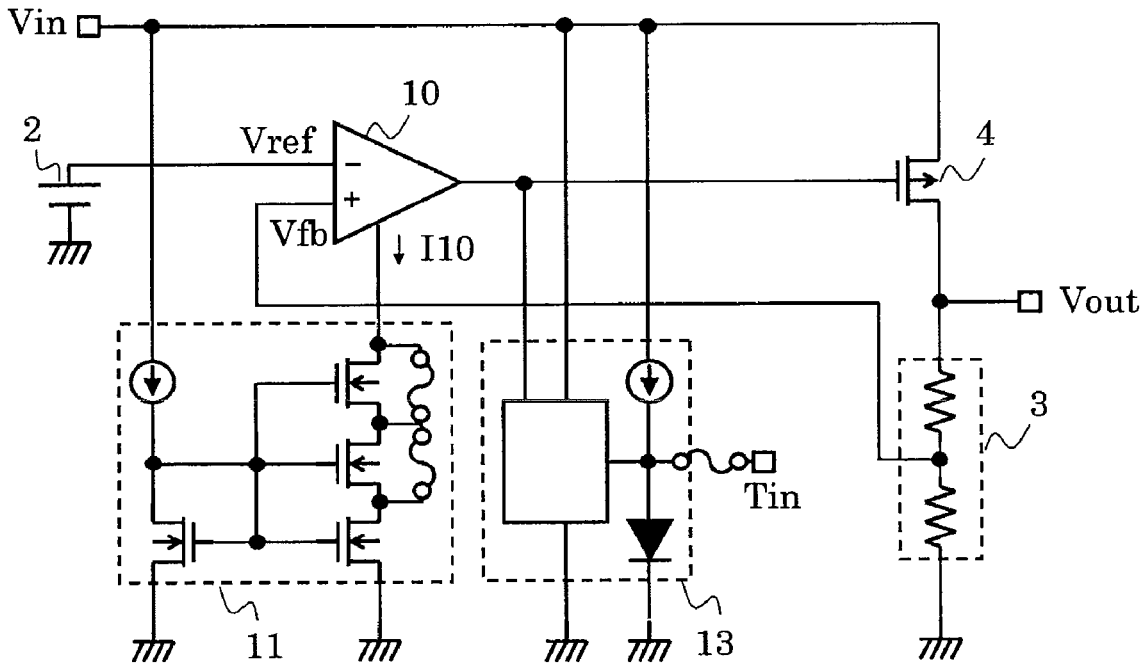
FIG. 2 PRIOR ART
FIG. 2 is a block diagram of a related-art voltage regulator.

FIG. 1 is a circuit diagram illustrating a voltage regulator according to a first embodiment of the present invention.

The voltage regulator according to the first embodiment includes a reference voltage circuit 2, a voltage divider circuit 3, an output transistor 4, a differential amplifier circuit 10, a constant current circuit 11, a protection circuit 13, a current output circuit 14, a control circuit 15, a switch circuit 16, and fuses 17 and 18. In the first embodiment, an overheat protection circuit is exemplified as the protection circuit 13, but an overcurrent protection circuit or another protection circuit may be used instead.

The output transistor 4 is connected between a power supply terminal 1 and an output terminal 5. The voltage divider circuit 3 is connected between the output terminal 5 and a ground terminal 6. The differential amplifier circuit 10 has input terminals connected to an output terminal of the reference voltage circuit 2 and an output terminal of the voltage divider circuit 3, and has an output terminal connected to a control terminal of the output transistor 4. The constant current circuit 11 is connected to the differential amplifier circuit 10. The protection circuit 13 has an output terminal connected to the control terminal of the output transistor 4.

The protection circuit 13 is described herein as an overheat protection circuit. The protection circuit 13 includes a thermosensitive element 101 having an output terminal connected to a test terminal Tio via the fuse 18. A current path to be supplied with an operating current of the protection circuit 13 is connected to the switch circuit 16. The switch circuit 16 is controlled to be on and off by the control circuit 15. The control circuit 15 may be, for example, a circuit that turns on the switch circuit 16 when detecting an overcurrent of the output terminal 5. Alternatively, the control circuit 15 may be, for example, a voltage detection circuit that turns off the switch circuit 16 when detecting that a voltage indicating a test start has been input to the output terminal 5. The constant current circuit 11 is a circuit for causing an operating current of the differential amplifier circuit 10 to flow. The constant current circuit 11 includes a constant current source, transistors forming a current mirror, and trimming fuses. The current output circuit 14 is connected between the constant current circuit 11 and the test terminal Tio via the fuse 17. The current output circuit 14 includes an NMOS transistor 21 for mirroring a current of the constant current circuit 11, and PMOS transistors 22 and 23.

The voltage regulator as described above operates as follows, and is capable of measuring circuit characteristics.

First, a method of measuring the current of the constant current circuit 11 is described.

The control circuit 15 controls the switch circuit 16 to be turned off. Accordingly, the test terminal Tio is connected to a diode between the ground terminal 6 and the test terminal Tio. In this state, a power supply voltage Vin is input to the power supply terminal 1 to operate the voltage regulator.

The NMOS transistor 21 mirrors the current of the constant current circuit 11. Further, the PMOS transistors 22 and 23 form a current mirror circuit to mirror a current of the NMOS transistor 21.

Consequently, when an ammeter is connected between the test terminal Tio and the ground, the current of the constant current circuit 11 can be measured because the impedance of the ammeter is lower than the impedance of the diode.

Then, based on the measured value, a current value of the constant current circuit 11, that is, a tail current 110 of the differential amplifier circuit 10 can be accurately adjusted through trimming.

Next, a method of measuring characteristics of the protection circuit 13 is described.

The fuse 17 is cut because the measurement of the constant current circuit 11 is finished. The control circuit 15 turns on the switch circuit 16. In this state, the power supply voltage Vin is input to the power supply terminal 1 to operate the voltage regulator. The voltage regulator outputs a predetermined output voltage Vout from the output terminal 5.

In the case of measuring the characteristics of the protection circuit 13, for example, in the case of measuring a temperature at which overheat protection is activated, an alternative voltage is input from the test terminal Tio. Through monitoring of the output voltage Vout of the output terminal 5, the temperature at which overheat protection is activated can be measured based on a protection operation of the protection circuit 13 and a value of the alternative voltage.

Then, based on the measured value, the characteristics of the protection circuit 13 can be accurately adjusted through trimming or the like.

Finally, the fuse 18 is cut to disconnect the test terminal Tio from the internal circuit.

As described above, the voltage regulator according to the first embodiment includes the current output circuit 14 for outputting the current of the constant current circuit 11 to the test terminal Tio, the switch circuit 16 for stopping the function of the protection circuit 13, and the fuse 17 provided between the current output circuit 14 and the test terminal Tio for measuring the characteristics of the protection circuit 13, and hence it is unnecessary to add a test terminal for measuring the tail current 110 of the differential amplifier circuit 10. Consequently, the tail current 110 of the differential amplifier circuit 10 can be accurately adjusted without increasing the chip size.

Second Embodiment

Figure 3:
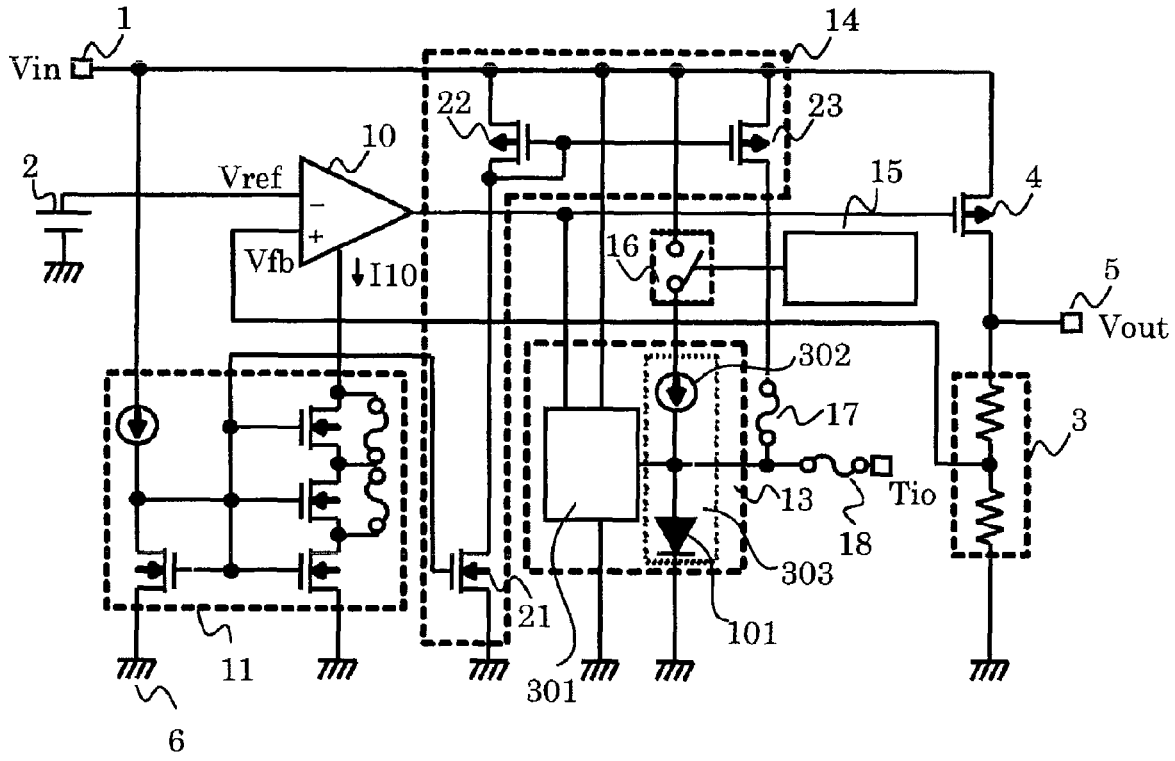
FIG. 3 is a circuit diagram illustrating a voltage regulator according to a second embodiment of the present invention.

FIG. 3 is a circuit diagram illustrating a voltage regulator according to a second embodiment of the present invention. FIG. 3 is different from FIG. 1 in that the number of switches included in the switch circuit 16 is reduced from two to one.

The protection circuit 13 includes a detection circuit 301 and a sensing circuit 303. The sensing circuit 303 includes a constant current circuit 302 and the thermosensitive element 101. The detection circuit 301 has an output connected to a gate of the output transistor 4, an input connected to the test terminal Tio via the fuse 18, and a power supply connected to the power supply terminal 1. The thermosensitive element 101 has an output terminal connected to the test terminal Tio via the fuse 18. The constant current circuit 302 is connected between the output terminal of the thermosensitive element 101 and the switch circuit 16. The other connections are the same as those of FIG. 1.

The control circuit 15 controls the switch circuit 16 to be turned off. Accordingly, the test terminal Tio is connected to a diode between the ground terminal 6 and the test terminal Tio. In this state, a power supply voltage Vin is input to the power supply terminal 1 to operate the voltage regulator.

The NMOS transistor 21 mirrors the current of the constant current circuit 11. Further, the PMOS transistors 22 and 23 form a current mirror circuit to mirror a current of the NMOS transistor 21.

Consequently, when an ammeter is connected between the test terminal Tio and the ground, the current of the constant current circuit 11 can be measured because the impedance of the ammeter is lower than the impedance of the diode.

Then, based on the measured value, a current value of the constant current circuit 11, that is, a tail current 110 of the differential amplifier circuit 10 can be accurately adjusted through trimming. Further, although the detection circuit 301 operates during the measurement of the current of the constant current circuit 11, no current flows from the detection circuit 301 to the test terminal Tio because a gate of a transistor (not shown) is connected to the input of the detection circuit 301. Consequently, even when the detection circuit 301 operates, no current flows from the detection circuit 301 or the sensing circuit 303, and the current of the constant current circuit 11 can be measured at the test terminal Tio. The other operations are the same as those in the first embodiment.

As described above, the voltage regulator according to the second embodiment is capable of accurately adjusting the tail current 110 of the differential amplifier circuit 10 while keeping the detection circuit 301 to operate, without adding a test terminal for measuring the tail current 110 of the differential amplifier circuit 10.

Third Embodiment

Figure 4:
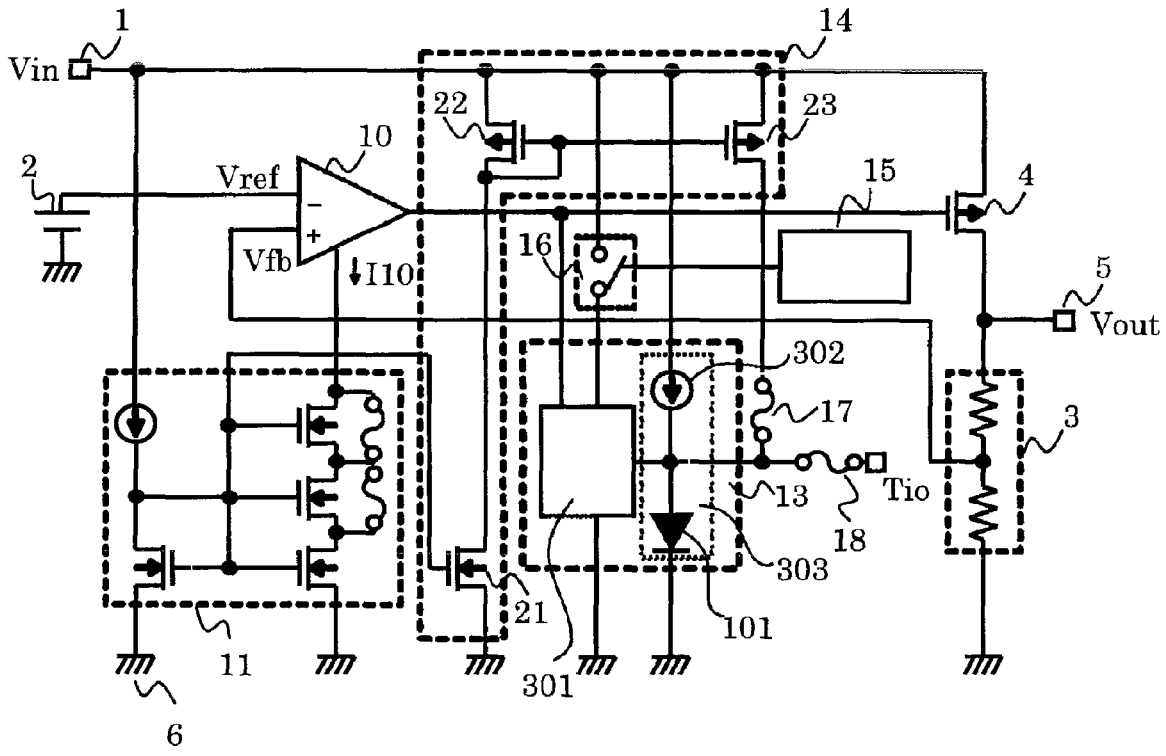
FIG. 4 is a circuit diagram illustrating a voltage regulator according to a third embodiment of the present invention.

FIG. 4 is a circuit diagram illustrating a voltage regulator according to a third embodiment of the present invention. FIG. 4 is different from FIG. 3 in that the switch circuit 16 is moved to the position between the power supply of the detection circuit 301 and the power supply terminal 1 and that the constant current circuit 302 is connected to the power supply terminal 1. The other connections are the same as those of FIG. 3.

The control circuit 15 controls the switch circuit 16 to be turned off. Accordingly, the test terminal Tio is connected to a diode between the ground terminal 6 and the test terminal Tio, to thereby stop the operation of the protection circuit 13. In this state, a power supply voltage Vin is input to the power supply terminal 1 to operate the voltage regulator.

The NMOS transistor 21 mirrors the current of the constant current circuit 11. Further, the PMOS transistors 22 and 23 form a current mirror circuit to mirror a current of the NMOS transistor 21.

Consequently, when an ammeter is connected between the test terminal Tio and the ground, the current of the constant current circuit 11 can be measured because the impedance of the ammeter is lower than the impedance of the diode. A current flowing through the thermosensitive element 101 is set to be proportional to the tail current 110 of the differential amplifier circuit 10 and is regarded as being significantly smaller than a current flowing through the PMOS transistor 23. In this case, the measurement of the current of the constant current circuit 11 is not greatly affected by the current flowing through the thermosensitive element 101, and hence the current of the constant current circuit 11 can be accurately measured.

Based on the current value, a current value of the constant current circuit 11, that is, the tail current 110 of the differential amplifier circuit 10 can be accurately adjusted through trimming. The other operations are the same as those in the second embodiment.

As described above, the voltage regulator according to the third embodiment stops the operation of the protection circuit 13 and sets the current flowing through the thermosensitive element 101 to be proportional to the tail current 110 of the differential amplifier circuit 10, thereby being capable of accurately measuring the current of the constant current circuit 11 and accurately adjusting the tail current 110 of the differential amplifier circuit 10.

What is claimed is:

1. A voltage regulator, comprising:

an error amplifier circuit;

a constant current circuit for supplying an operating current of the error amplifier circuit;

a protection circuit;

a test terminal for measuring characteristics of the protection circuit;

a current output circuit for outputting a current of the constant current circuit to the test terminal;

a fuse provided between the current output circuit and the test terminal; and a switch circuit for stopping an operation of the protection circuit.

2. A voltage regulator according to claim 1, further comprising a control circuit for controlling the switch circuit, wherein the control circuit controls the switch circuit to stop the operation of the protection circuit when the current of the constant current circuit is output from the test terminal.

3. A voltage regulator according to claim 2, wherein the protection circuit comprises:

a sensing circuit for stopping the operation of the protection circuit in response to the switch circuit; and a detection circuit for detecting a voltage of the sensing circuit.

4. A voltage regulator according to claim 3, wherein the sensing circuit comprises a diode for detecting temperature.

* * * * *